US011511164B2

(12) United States Patent
Francis

(10) Patent No.: US 11,511,164 B2
(45) Date of Patent: Nov. 29, 2022

(54) BALANCED BALL DEVICE INCLUDING A SENSING UNIT FOR PERFORMANCE MEASUREMENT

(71) Applicant: Danya Ganj Francis, Tequesta, FL (US)

(72) Inventor: Danya Ganj Francis, Tequesta, FL (US)

( * ) Notice: Subject to any disclaimer, the term of this patent is extended or adjusted under 35 U.S.C. 154(b) by 0 days.

(21) Appl. No.: 17/340,515

(22) Filed: Jun. 7, 2021

(65) Prior Publication Data

US 2021/0379452 A1 Dec. 9, 2021

Related U.S. Application Data

(60) Provisional application No. 63/035,433, filed on Jun. 5, 2020.

(51) Int. Cl.

| | |
|---|---|
| ***A63B 43/00*** | (2006.01) |
| ***A63B 41/08*** | (2006.01) |
| ***A63B 41/02*** | (2006.01) |
| *A63B 41/00* | (2006.01) |
| *A63B 102/18* | (2015.01) |

(52) U.S. Cl.

CPC ..... *A63B 43/004* (2013.01); *A63B 41/02* (2013.01); *A63B 41/08* (2013.01); *A63B 43/002* (2013.01); *A63B 2041/005* (2013.01); *A63B 2102/18* (2015.10); *A63B 2220/12* (2013.01); *A63B 2220/40* (2013.01); *A63B 2220/73* (2013.01); *A63B 2220/833* (2013.01); *A63B 2225/54* (2013.01); *A63B 2243/007* (2013.01); *A63B 2243/0025* (2013.01); *A63B 2243/0054* (2013.01)

(58) Field of Classification Search

CPC ..... A63B 43/004; A63B 41/02; A63B 43/002; A63B 2041/005; A63B 2102/18; A63B 2220/212; A63B 2220/40; A63B 2220/73; A63B 2220/833; A63B 2225/54; A63B 2243/0025; A63B 2243/0054; A63B 2243/007

See application file for complete search history.

(56) References Cited

U.S. PATENT DOCUMENTS

| | | | | |
|---|---|---|---|---|
| 4,577,865 A * | 3/1986 | Shishido | ..... | A63B 43/00 473/446 |
| 4,595,200 A * | 6/1986 | Shishido | ..... | A63B 43/00 473/570 |
| 5,236,383 A * | 8/1993 | Connelly | ..... | A63B 43/007 446/219 |
| 6,157,898 A | 12/2000 | Marinelli | | |
| 7,014,581 B2 * | 3/2006 | Ng | ..... | A63B 41/00 473/570 |

(Continued)

*Primary Examiner* — Steven B Wong
(74) *Attorney, Agent, or Firm* — The Concept Law Group, PA; Scott D. Smiley; Scott M. Garrett

(57) ABSTRACT

A football device includes an outer skin and an inner bladder to be inflatable and substantially resemble and perform like an actual football. The football device includes a sensor unit that can sense various performance metrics and wirelessly communicate data to another device such as a mobile device. To maintain a feel and performance as close to an actual football as possible, a battery powering the sensor unit is wirelessly recharged.

7 Claims, 19 Drawing Sheets

(56) References Cited

U.S. PATENT DOCUMENTS 8,663,040 B2 * 3/2014 Kortegast ..... A63B 71/0036 473/570
8,870,690 B2 10/2014 Krysiak et al.
8,992,353 B1 * 3/2015 Kortegast ..... A63B 43/06 362/800
9,242,150 B2 1/2016 Gale
9,339,710 B2 5/2016 Thurman et al.
9,384,676 B2 * 7/2016 Costain ..... G09B 19/0038
9,517,389 B2 * 12/2016 Won ..... A63B 41/00
9,526,951 B1 12/2016 Ganson
9,586,099 B2 * 3/2017 Holthouse ..... A63B 41/04
9,636,550 B2 * 5/2017 Thurman ..... A63B 43/004
10,010,778 B2 7/2018 Marty et al.
10,076,685 B2 * 9/2018 King ..... A63B 15/02
10,252,118 B2 4/2019 Krysiak et al.
10,799,769 B2 * 10/2020 Wolfinbarger ..... A63B 43/06
11,000,751 B1 * 5/2021 Baillie ..... A63B 43/004
2005/0233815 A1 10/2005 McCreary et al.
2006/0135297 A1 * 6/2006 Cruciani ..... A63B 43/00 473/570
2007/0021244 A1 * 1/2007 Ko ..... A63B 43/06 473/570
2009/0325739 A1 12/2009 Gold
2010/0184563 A1 * 7/2010 Molyneux ..... A43B 1/0054 482/1
2012/0058845 A1 * 3/2012 Crowley ..... A63B 41/00 473/604
2012/0244969 A1 * 9/2012 Binder ..... G08B 21/182 473/570
2014/0221137 A1 * 8/2014 Krysiak ..... A63B 47/00 473/570
2014/0274498 A1 * 9/2014 Berggren ..... A63B 43/004 473/570
2015/0328516 A1 * 11/2015 Coza ..... G16H 40/60 473/446
2016/0074714 A1 * 3/2016 Krysiak ..... A63B 45/00 473/570
2016/0107046 A1 * 4/2016 Krysiak ..... A63B 45/00 473/605
2017/0232305 A1 8/2017 Bed
2018/0043218 A1 * 2/2018 Hu ..... A63B 43/06
2018/0193696 A1 7/2018 Gwydir et al.
2019/0091520 A1 * 3/2019 Corbeil ..... A63B 41/08
2020/0391084 A1 * 12/2020 Ianni ..... A63B 41/04

* cited by examiner

BALANCED BALL DEVICE INCLUDING A SENSING UNIT FOR PERFORMANCE MEASUREMENT

CROSS REFERENCE

This application claims priority to U.S. provisional application No. 63/035,433, filed Jun. 5, 2020, the entirety of which is hereby incorporated by reference.

FIELD OF THE INVENTION

The present invention relates generally to ball sports, and in particular to the measurement of throwing and kicking accuracy and providing feedback on accuracy as well as ball dynamics.

BACKGROUND OF THE INVENTION

In training various ball sports, especially American football, there have recently been developed in-ball sensors that measure acceleration in various dimensions to provide feedback to the player such as, for example, spin rate, air time, and launch velocity. Typically the sensor is embedded in the ball and is designed to use low power wireless communication to transmit data to an external device. However, when the battery does fail, the training ball simply becomes an ordinary ball as the sensor battery cannot be accessed or recharged. Furthermore, while the sensor can give an indication of ball dynamics, it doesn't indicate, for example, accuracy in arriving at a target.

Therefore, a need exists to overcome the problems with the prior art as discussed above.

SUMMARY

In accordance with some embodiments of the inventive disclosure, there is provided a ball device that includes a body having an outer skin surrounding a bladder, a first opening and a second opening at opposing sides of the body, a first sleeve extending into the body and the bladder at the first opening, a second sleeve extending into the body and the bladder at the second opening, a first sensor unit configured to be housed and retained in the body in the first sleeve, a counterweight or second sensor unit configured to be housed and retained in the body in the second sleeve, and wherein the first sensor unit includes circuitry for measuring acceleration, altitude, and proximity to a proximity beacon.

In accordance with a further feature, the body is configured in an American football configuration.

In accordance with a further feature, there is further included a pickup coil disposed inside the body.

In accordance with a further feature, the pickup coil is disposed between the outer skin and the bladder.

In accordance with a further feature, the pickup coil has two terminals which are each coupled to a respective one of a pair of electrodes in the first sleeve that mate with corresponding ones of a pair of electrodes on the first sensor unit.

In accordance with a further feature, the first sensor unit comprises threads that mate with corresponding threads in a collar in the first opening.

In accordance with a further feature, the first sensor unit includes a processor; an accelerometer operably coupled to the processor, a satellite location receiver that is operably coupled to the processor, a wireless networking transceiver operably coupled to the processor, and wherein the processor is configured to detect acceleration events as indicated by an output of the accelerometer.

In accordance with some embodiments of the inventive disclosure, there is provided a ball device which includes a body, a bladder disposed within the body and having a sensor pocket formed in the bladder, a sensor unit disposed in the sensor pocket of the bladder, and wherein the sensor unit includes circuitry for measuring acceleration, altitude, and proximity to a proximity beacon, and communicating data wirelessly with another device.

In accordance with a further feature, the body is configured in an American football configuration.

In accordance with a further feature, the body is configured in a baseball configuration.

In accordance with a further feature, the body is configured in a soccer ball configuration.

In accordance with a further feature, the body is configured in a bowling ball configuration.

In accordance with a further feature, there is further includes a wireless charging cradle configured to receive and hold the ball device while providing a wireless power signal to the sensor unit.

In accordance with some embodiments of the inventive disclosure, there is provided a ball device which includes a body having a size, shape, and weight that are substantially similar to an athletic ball, at least one sensor unit disposed in the body, the sensor unit including a rechargeable battery, an accelerometer, a processor operably coupled to the accelerometer, at least one of a proximity sensor or a satellite location receiver, and a wireless networking transceiver, and a pickup coil operably coupled to the sensor unit.

In accordance with a further feature, the body includes an outer skin and a bladder housed inside the outer skin that is configured to be inflated.

In accordance with a further feature, the outer skin includes an opening in correspondence with a sleeve in the bladder, wherein the at least one sensor unit is removably retained in the sleeve.

In accordance with a further feature, the opening in the outer skin is a first opening, the sleeve is a first sleeve, the outer skin includes a second opening opposite the first opening, and the bladder includes a second sleeve opposite the first sleeve, the ball device further includes a counterweight removably retained in the second sleeve, wherein the counterweight has a weight that is equal to a weight of the at least one sensor unit removably retained in the first sleeve.

Although the invention is illustrated and described herein, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). If not expressly stated otherwise, any terms of approximation, such as "substantially," "about," or "approximately" will be understood to be within a range of +1-5% of the units of applicable measure. In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1A:
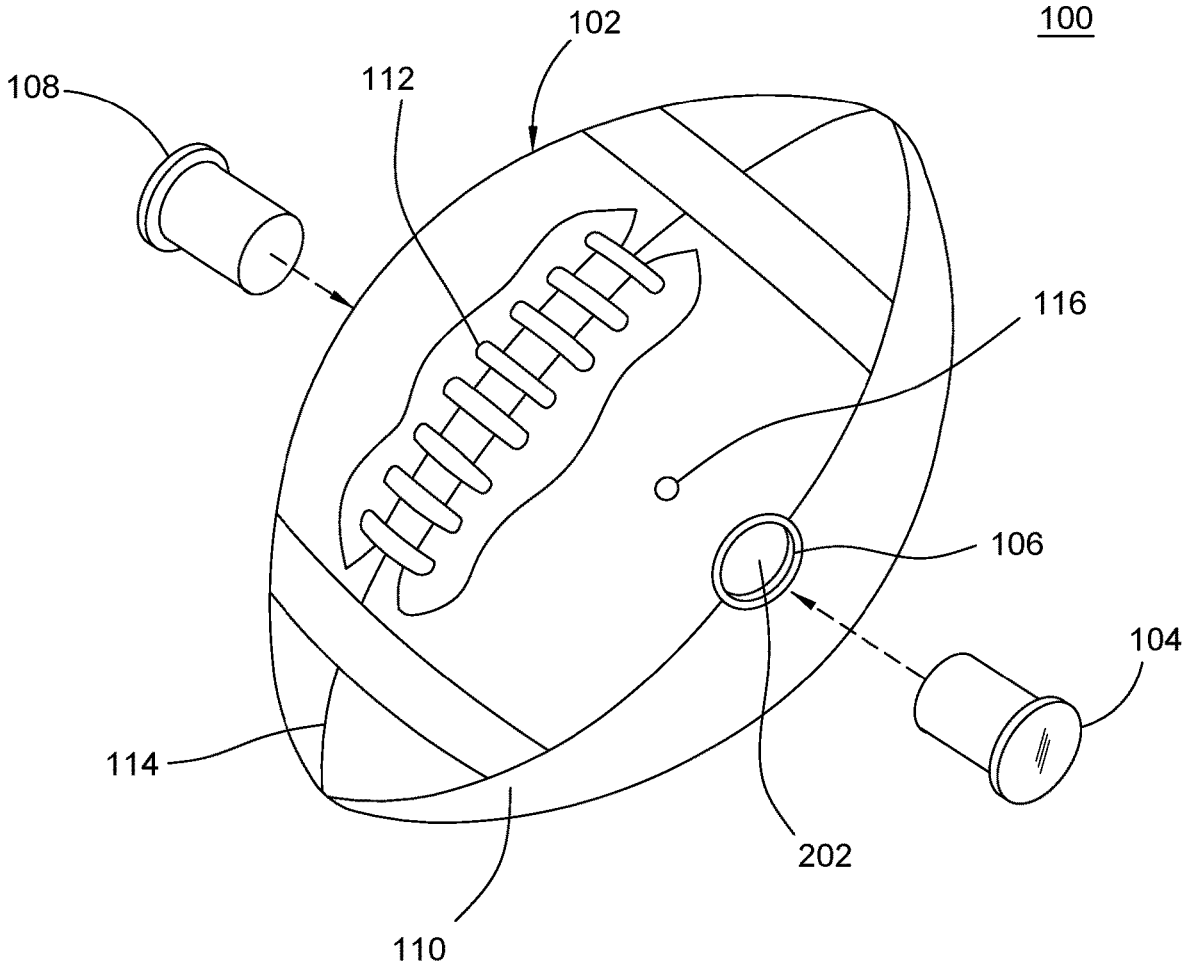
FIG. 1A is an exploded view of a football device including a sensor unit and a counterweight, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Generally, a ball device substantially resembling an athletic ball is disclosed which includes one or more sensor units for measuring various dynamics of the ball device, particularly when used in a training exercise. The sensor unit can detect acceleration events, which imply an action being imparted to the ball device (e.g. being thrown, hit, kicked, hiked, handed off, etc.). The sensor unit can further sense and quantize parameters such as time (using a clock), altitude, location, proximity to another object, velocity, and spin. The data produced by the sensor unit can be wirelessly transmitted to a remote device, such as a phone device, tablet computer, or equivalent device, for viewing and analysis. Although the foregoing example is in the form of an American football, it will be appreciated by those skilled in the art that the inventive embodiments can be incorporated into other athletic ball/device configurations.

Figure 1B:
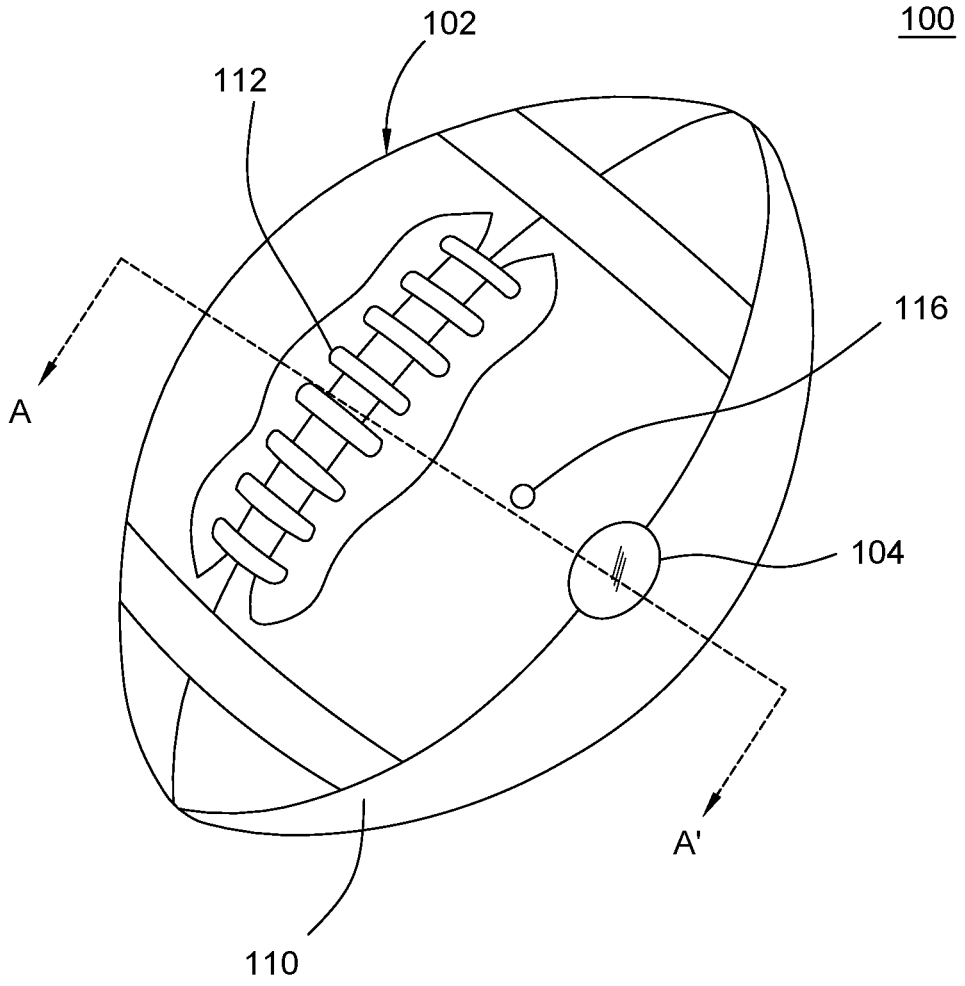
FIG. 1B is a assembled view of a football device, in accordance with some embodiments.

FIG. 1A is an exploded view of a football device 100 including a sensor unit 104 and a counterweight 108, in accordance with some embodiments. The football device 100 includes a football body 102 that can be substantially similar to a standard American football configuration that is inflatable, and has a flexible/compliant skin. The skin can form a hollow structure that can house an inflatable bladder that can be inflated with air at an inflation valve 116, as is known. The football body 102 is made of an outer skin 110 and includes a pair of opposing openings such as opening 106 which is configured to receive a sensor unit 104. In some embodiments the sensor unit 104 can include threads that correspond to threads in the opening 106 and the outer surface of the sensor unit 106 can fit flush with outside of the body 102, and can be shaped to form a continuous surface with the outside of the body 102. The sensor unit 104 includes electronic circuitry for wireless networked communication, sensing acceleration in multiple dimensions, sensing altitude, sensing proximity to a target beacon, and a battery that can be replaced or recharged. The opening 106 can be the top of an airtight sleeve that is configured to receive and hold the sensor unit 104. The counterweight 108 is provided in a similar form factor to the sensor unit 104 and fits into an opening on the other side of the body 102 from opening 106. The counterweight 108 is configured to weigh the same as the sensor unit so that the football device 100 is balanced and does not wobble eccentrically when thrown normally (e.g. a spiral throw). In some embodiments, the counterweight 108 can instead be a second sensor unit that includes different sensing circuitry than that of sensor unit 104 and can likewise communicate wirelessly with a remote device or with sensor unit 104 to have sensor unit 104 relay sensed data to a remote device. In some embodiments, a second sensor unit can include a GPS or GNSS receiver for use in accuracy sensing. FIG. 1B shows the football device 100 in an assembled stated, with sensor unit 104 installed in receiving sleeve 202. Line A-A' indicates the plane of cross-sectional view 200 in FIG. 2A.

Figure 2A:
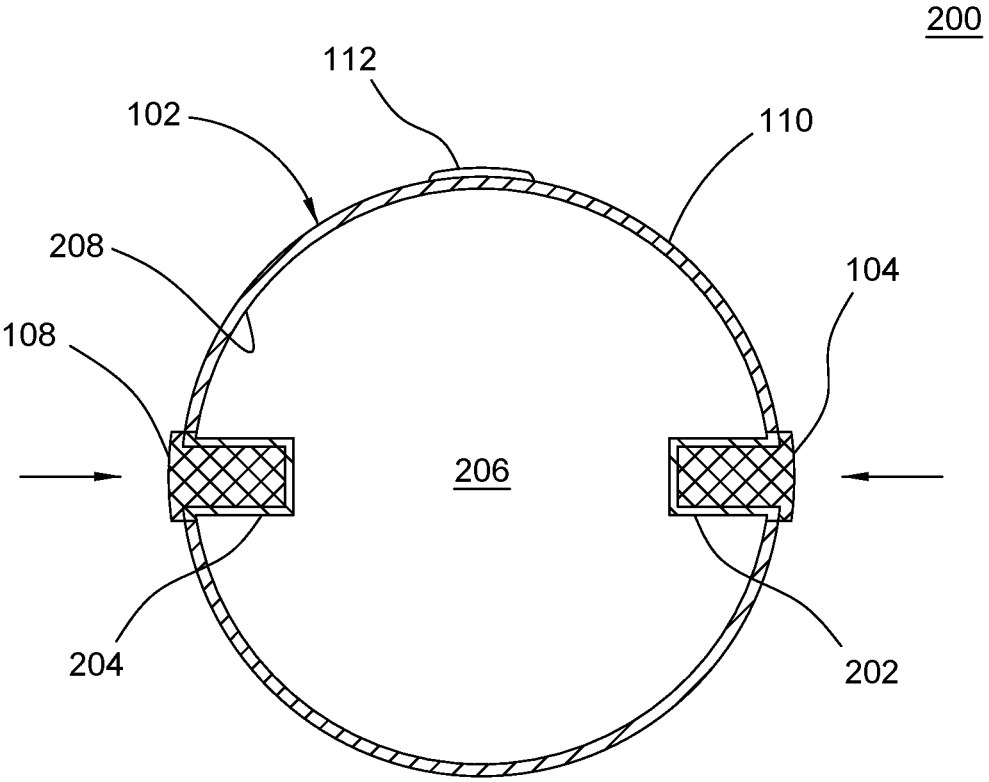
FIG. 2A is a side cross-sectional view of a football device includes a sensor unit and a counterweight inserted into the body of the football device, in accordance with some embodiments.

FIG. 2A is a side cross-sectional view 200 of a football device 100, taken along line A-A' of FIG. 1B, that includes a sensor unit 104 and a counterweight 108 (or second sensor unit) inserted into the body 102 of the football device, in accordance with some embodiments. The sensor unit 104 fits into a receiving sleeve 202 and likewise the counterweight 108 fits into a receiving sleeve 204. The receiving sleeves 202, 204 are located in correspondence with the openings (e.g. 106) in the outer skin 110. The top of the sleeves 202, 204 can be sized to accept a top portion of the sensor unit 104 and the counterweight 108, which can both be threaded to thread into corresponding threads in the top portions of the sleeve 202, 204. The interior 206 of the body can be inside an inflatable bladder 208 that is configured to minimize pressure against the sleeves 202, 204 when inflated, but to otherwise exert pressure evenly through the remaining inside surface of the body 102. In some embodiments the receiving sleeves 202, 204 can be rigid or semi-rigid inserts having a generally cylindrical shape sized to receive the sensor unit 104 and counterweight 108 therein, respectively. Each receiving sleeve 202, 204 can have a rim that extends outward at an opening of the sleeve to bond the sleeve to the material of the bladder 208. In some embodiments the receiving sleeves 202, 204 can be formed in the material of the bladder 208 as a pocket, requiring the sensor unit 104 and counterweight 108 to be first inserted into the sleeves 202, 204 before inflating the bladder 208.

Figure 2B:
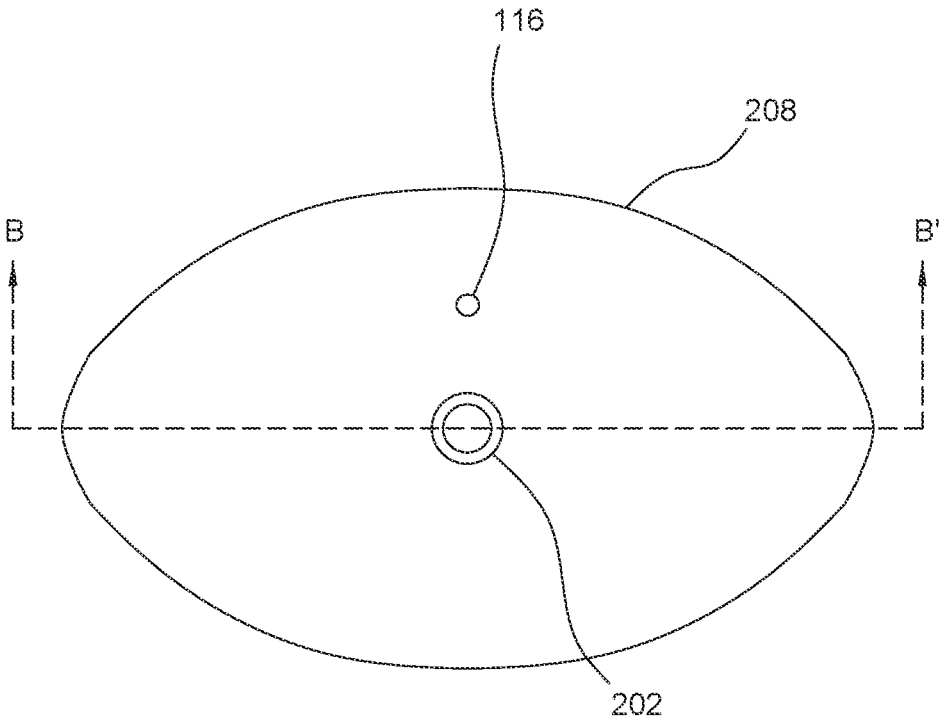
FIG. 2B is a side view of a bladder having a sleeve for a sensor unit to be used inside of a football device, in accordance with some embodiments.
Figure 2C:
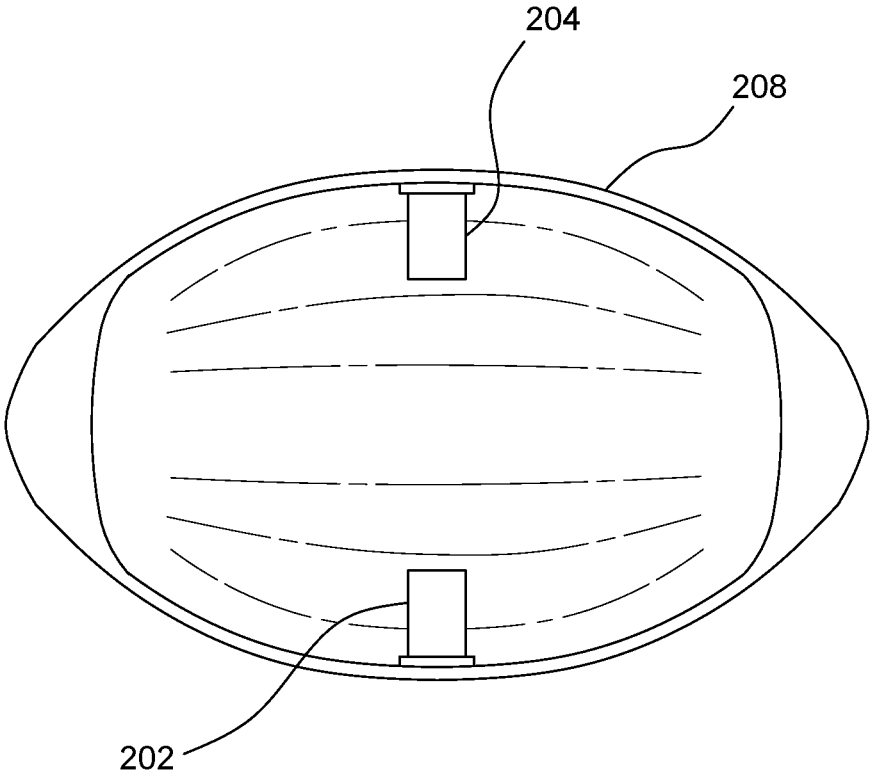
FIG. 2C is a cut-away view of a bladder as shown in FIG. 2B, in accordance with some embodiments.
Figure 2D:
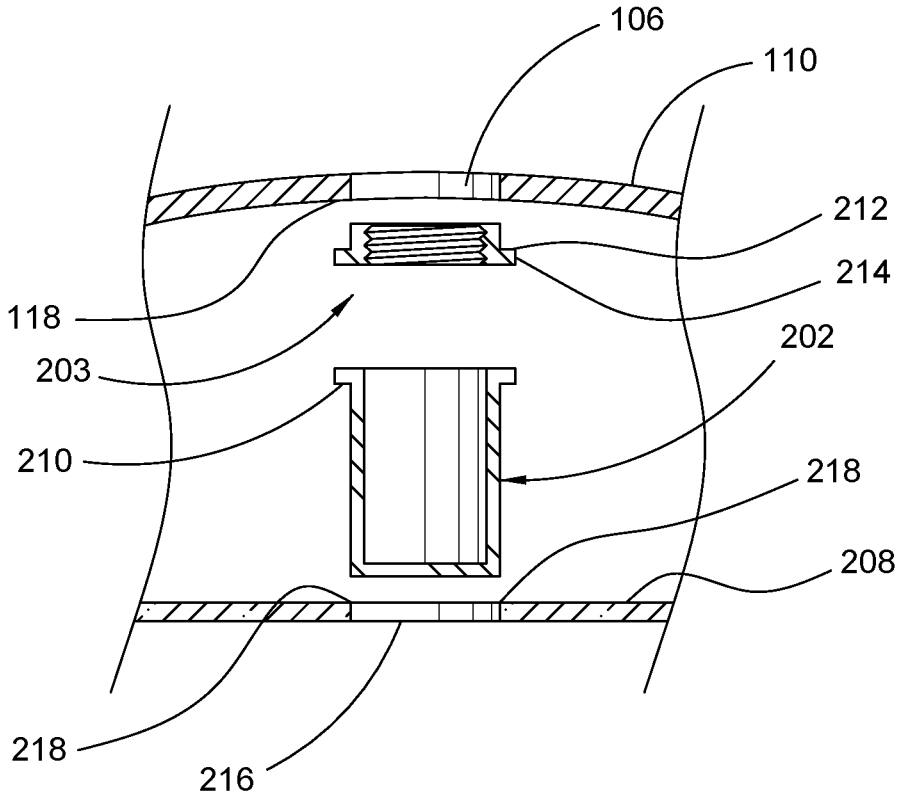
FIG. 2D is a cut-away view of a football device showing a detail of FIG. 2B with the various components in an exploded view, and in particular showing a receiving sleeve and collar, in accordance with some embodiments.

In FIG. 2B there is shown a side view of a bladder 208 with receiving sleeve 202, and inflation valve 116. The inflation valve 116 can be a conventional inflation valve as is commonly provided on footballs and other inflatable sports balls. Line B-B' indicates a plane through which a sectional view in FIG. 2C is taken. In FIG. 2C a portion of the bladder 208 is removed, showing the interior (206) of the bladder 208. The receiving sleeves 202, 204 can be seen extending into the bladder 208 on opposite sides of the bladder. FIG. 2D shows an exploded side cross section of a side of a football body 102 in accordance with some embodiments. The outer skin 110 has an opening 106 into which the collar 212 of a receiving member 203 is inserted. The collar 212 is threaded on an inside surface to mate with the threads on the sensor unit 104 (when a threaded engagement/retaining arrangement is used). The receiving member 203 can also have a flange 214 that extends outward around the inner side of the receiving member 203. A receiving sleeve 202 can be a cup shaped member having a flange 210 the extends outward around the opening of the sleeve 202. In some embodiments the receiving member 203 and the sleeve 202 can be a unitary structure rather than two separate structures. The flange 210 of the sleeve 202 can be joined the wall of the bladder 208 around an opening 216. The opening can be a hole in the wall of the bladder 208 or an opening into a pocket formed in the wall of the bladder 208. When the receiving member 203 and sleeve 202 are separate members, the flanges 210, 214 can be joined (e.g. bonded) together. When assembled, the wall of the bladder 208 will be in contact with the inner surface of the outer skin 110, pressing outward due to pressure in the bladder 208. The flanges 210, 214 will be captured between the wall of the bladder 208 and the outer skin 110. The same structure can be used on the other side of the football to receive and house the counterweight or second sensor unit. The receiving member 212 can be secured to the football skin 110 by glue, stiches, and other means to withstand the punishment of training exercises and secure the sensor unit therein. The sensor unit, being screwed into the receiving member to be flush with outside of the skin 110, is likewise secured in the receiving member 212, thus removal of the sensor unit is not preferable. Accordingly, wireless charging of the battery is preferred so that the sensor unit does not need to be removed from the football device.

Figure 3:
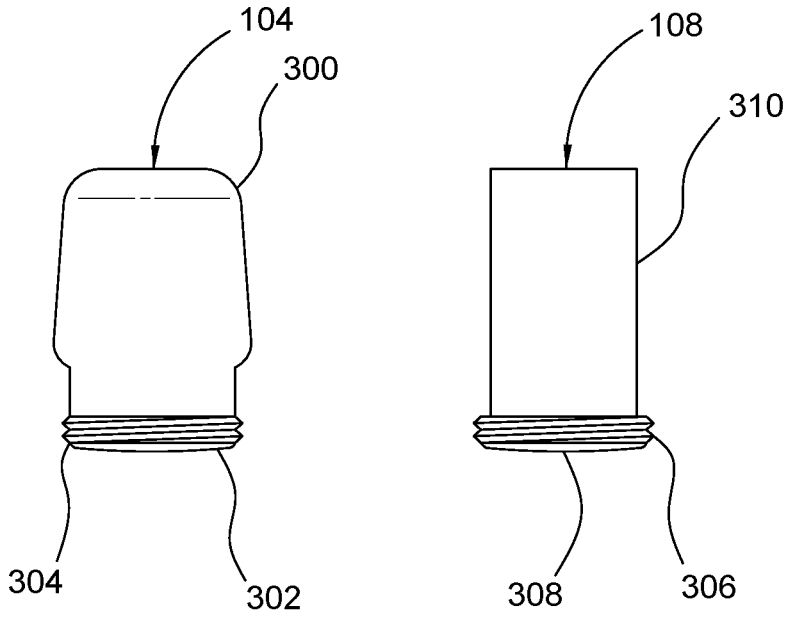
FIG. 3 is a side view of the sensor unit and counterweight for use with a football device, in accordance with some embodiments.

FIG. 3 is a side view of the sensor unit 104 and counterweight 108, in accordance with some embodiments. The sensor unit 104 includes a main body 300 and a threaded top 302 having an outer or exterior surface 304. The main body 300 houses electronic circuitry and a battery, and fits into a receiving sleeve in a football device body. The outside housing of the main body 300 and the top 302 can be made of a polymeric material. The top 302 can be threaded onto the main body 300 so that it can be removed to replace/recharge the battery. Alternatively, the main body 300 can house electrical contacts or an inductive coil that can be used for wired or wireless charging. The counterweight 108 includes a weighted body 310 and a top 306 having an outside surface 308. The weighted body 310 is configured to weigh substantially the same as the sensor unit 104. And as with the sensor unit 104, the top 306 of the counterweight can be threaded on the outside to mate with threads in a receiving sleeve formed in the body of a football device.

Figure 4:
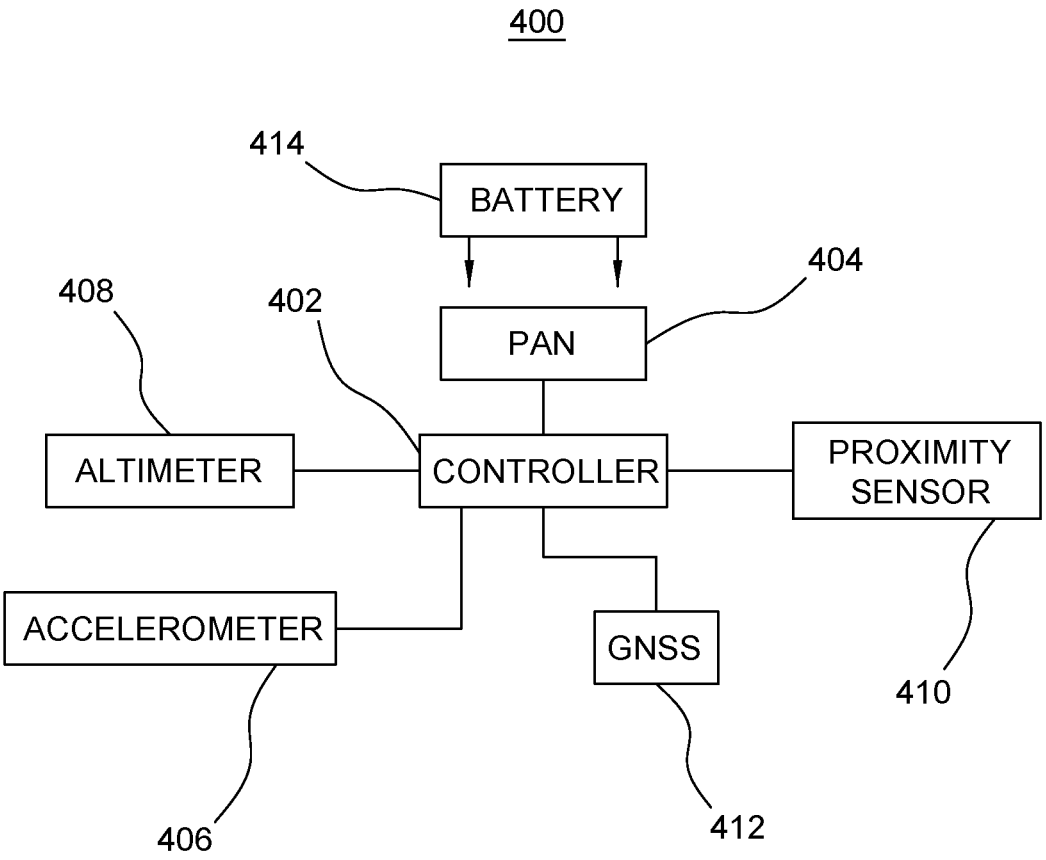
FIG. 4 is a block schematic diagram of a sensor device for a football device, in accordance with some embodiments.

FIG. 4 is a block schematic diagram of a sensor device circuit 400 for a football device, in accordance with some embodiments. The sensor device circuit 400 can be housed in the main body of a sensor device 104, and can be disposed on a circuit board, as is known. A controller 402 can be a special purpose processor or microcontroller that includes a ROM memory and a suitable amount of RAM memory of operating instruction code stored in the ROM memory. The controller 402 therefore performs instruction code designed to carry out the described functionality and into interface with the various components of the sensor device circuitry. The controller can be operably coupled to a personal area network module 404 that performs wireless communication at a very low power using a known wireless networking protocol such as, for example, that described in IEEE 802.15 (including BLUETOOTH) or 802.11 (including WiFi). Thus, the PAN module 404 is a wireless (radio) networking transceiver that can connect to, and communicate with external devices that are similarly equipped, and data acquired by the sensor device can be transmitted to the external device(s). The controller can further operate an accelerometer 406 that can measure acceleration in three orthogonal dimensions, as well as rotational acceleration. Since the sensor unit 104 is offset from the center of the football device, a correction factor can be determined and applied to acceleration measurements to indicate the acceleration that would be evident at the center of the football device. Further, as is known, velocity can be determined from acceleration measurements by integrating over time. Thus, the controller 402 can include a clock based on a clock oscillator signal which can be used to integrate acceleration over time. The circuitry 400 can further include an altimeter 408 that can measure altitude based on ambient air pressure, and altitude measurements can be periodically provided to the controller 402 for processing. The controller 402 can be further coupled to a proximity sensor 410 that measures the signal strength of a signal transmitted by a proximity beacon to estimate the distance to the proximity beacon. In some embodiments a location module, such as a satellite positioning system receiver 412 (e.g. GNSS) can be used to monitor location of the ball, as well as speed (e.g. change of location over time). Although conventional satellite positioning resolution is only accurate to several meters, newer satellite positioning systems are in development that will allow much smaller resolution of location. The use of such a satellite positioning receiving could be used instead of the proximity sensor 410, or in addition to the proximity sensor 410. Finally, a battery 414 provides power to all of the circuitry. The battery 414 can be a primary (non-rechargeable) or a secondary (rechargeable) type. In some embodiments the battery is a rechargeable lithium based battery.

Figure 5:
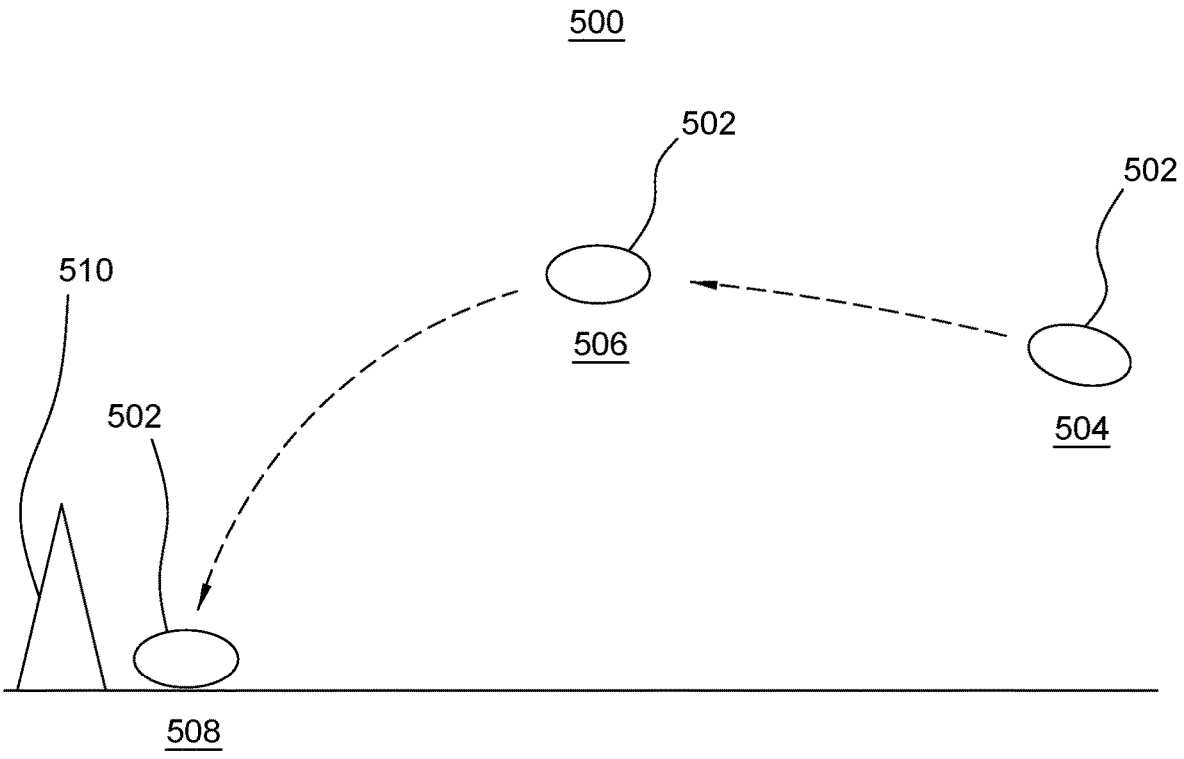
FIG. 5 is a diagram of a simple exercise using a football device having a sensor unit, in accordance with some embodiments.

FIG. 5 is a diagram of a simple exercise 500 using a football device 502, in accordance with some embodiments. Specifically the football device 502 include a sensor unit (e.g. 104) that can be controlled wirelessly by a mobile device (e.g. cellular phone, tablet) via a wireless network link. The mobile device can set up and activate the senor unit to sense and record data produced by its sensors using sensors such as those shown in FIG. 4. Upon the sensor unit being activated, the football device 502 can be thrown or kicked from a first position 504, wherein the sensor unit has commenced measuring acceleration, altitude, and proximity. In general, the sensor unit monitors its acceleration. When a sufficiently large acceleration event occurs, it is assumed to indicate the ball has been thrown or kicked. A second sufficiently large acceleration event can be assumed to indicate the ball has hit the ground or been caught. Thus, at the first position 504, the sensor unit will detect a first acceleration event when it is kicked or thrown. As the football travels, multiple data are monitored and recorded, which can include, time, altitude, spin rate and spin direction, and location. As the football device 502 travels to a peak height, the altitude is recorded for later examination. Finally the football device 502 can land on the ground, or be caught, at position 508, producing a second acceleration event. A proximity beacon 510 can transmit, or sense, a signal to or from the sensor unit of the football device 502. In some embodiments the proximity beacon can be worn on the body of a person (e.g. a receiver). The proximity sensor of the sensor unit can measure the strength of the signal provided by the proximity beacon to estimate a distance to the proximity beacon 510. During the distance travelled from position 504 to position 508 the sensor unit can track acceleration throughout the flight. Further, or alternatively, the sensor unit can monitor and record its location using a satellite location receiver.

In some embodiments the measured proximity to the proximity beacon can be used as part of a game where different people can take turns through or kicking the football device 502 to see who can score the closest throws/kicks or combinations of throws and kicks. As such, it will be readily apparent to those skilled in the art that the sensor unit and counterweight can be used in ball devices for other sports such as soccer, bowling, baseball, and so on. After a throw or kick, the acceleration altitude, and proximity data can be retrieved from the sensor unit and processed on a connected device (computer, cellular phone, table, etc.) to produce the velocity data, including rotational velocity. These metrics can be used by players to improve their performance.

Figure 6A:
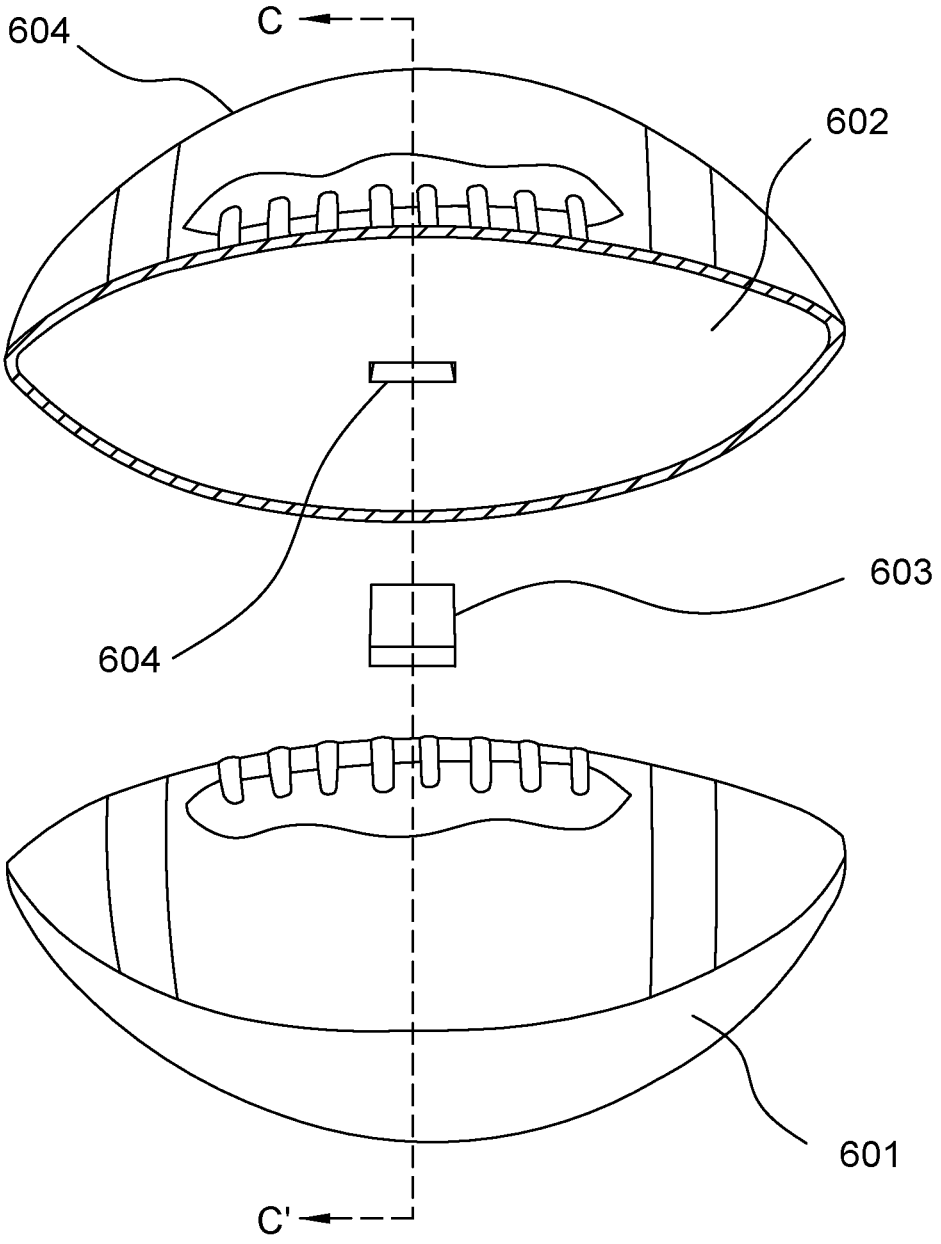
FIG. 6A is an exploded view of football device having in internal bladder configured to hold a wireless sensor module, in accordance with some embodiments.

FIG. 6A is an exploded view of a football device 600 including a sensor unit 603 and a specialized bladder 602, in accordance with some embodiments. The football device 600 includes a football body 601 that can be substantially similar to a standard American football that is inflatable, and has a flexible/compliant skin. The skin can form a hollow structure that can house an inflatable bladder 602 that can be inflated with air, as is known. The football body 601 includes a specialized bladder 602 with a sensor pocket 604 which is configured to receive a sensor unit 603. In some embodiments the sensor unit 603 can include encapsulated sensors unit which can fit within the specialized bladder 602. The sensor unit 603 includes electronic circuitry for wireless networked communication, sensing acceleration in multiple dimensions, sensing altitude, sensing proximity to a target beacon, and a battery that can be recharged wirelessly, substantially as shown in FIG. 4. The specialized bladder 602 can be inflated and configured to receive and hold an encapsulated sensor unit 603. The football assembly weight is configured to weigh the same as a typical football and is balanced so as not to wobble eccentrically when thrown normally (e.g. a spiral throw).

Figure 6B:
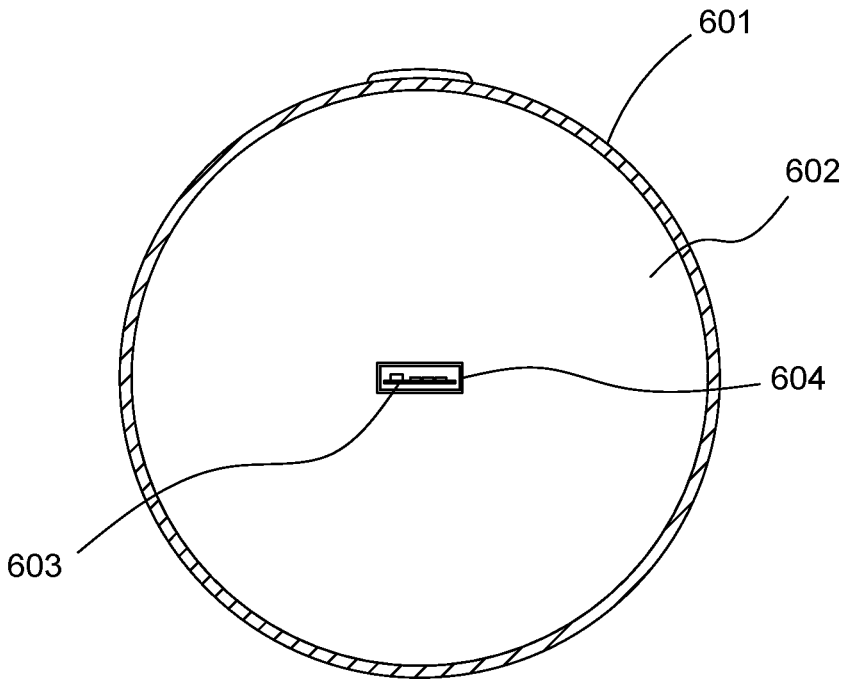
FIG. 6B is a side cross sectional view of a football device having an internal bladder configured to hold a wireless sensor module.

FIG. 6B is a side cross-sectional view of a football device taken along line C-C' of FIG. 6A, and shows the encapsulated sensor unit 603 and a specialized bladder 602 inserted into the body 601 of the football device, in accordance with some embodiments. The sensor unit 603 fits into a pocket in the specialized bladder 602 and is suspended or otherwise held in the center of the ball. The specialized bladder 602 can be an inflatable bladder that is configured to minimize pressure against the assembled sensors 03, when inflated, but to otherwise exert pressure evenly through the remaining inside surface of the body 601. In some embodiments the specialized bladder 602 can be an open cell foam bladder having an impermeable skin around the foam body, and the pocket 604 can be in the center of the foam body. Being an open cell foam, air can pass throughout the foam, allowing for it to be pressurized.

Figure 7:
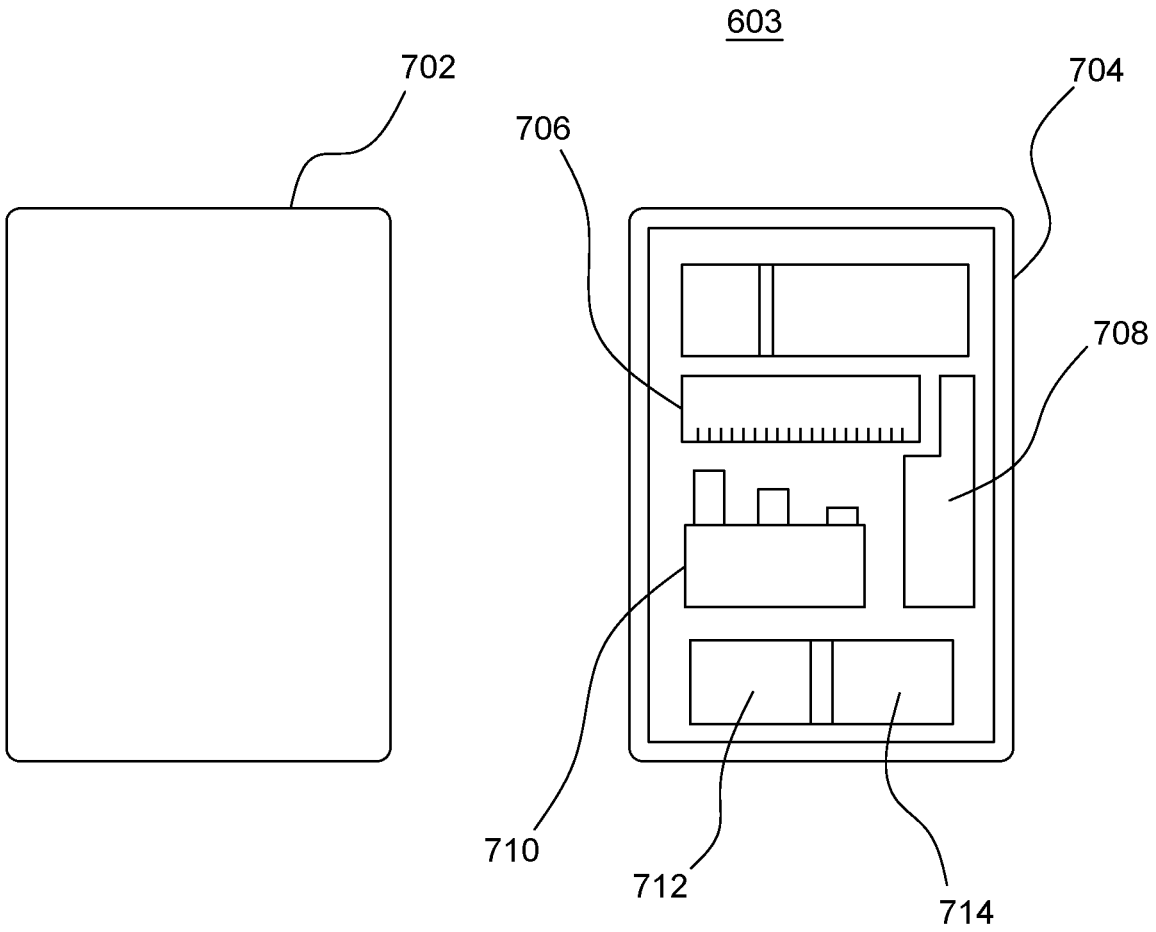
FIG. 7 is a plan view of a sensor unit module, for using in a sensor unit for a football device, in accordance with some embodiments.

FIG. 7 is a top plan view of the sensor unit 603, in accordance with some embodiments. The sensor unit 603 includes a main body and a cover 702, which is shown removed and to the side of the circuit board 704 here. The cover 702 houses a circuit board 704 on which electronic circuitry and a battery are disposed and electrically connected. The cover 702 can be made of a polymeric material. Alternatively, the cover 702 can house electrical contacts or an inductive coil that can be used for wireless charging. The circuitry of the sensor unit 603 can include a multi-axis accelerometer 706, timing circuitry 710, wireless communication circuitry 708, altimeter 712, satellite location receiver 714, and so on, that allows the sensor unit to detect movement, acceleration, and time to calculate distance, spin rate, and other units of interest for training and competition purposes.

Figure 8A:
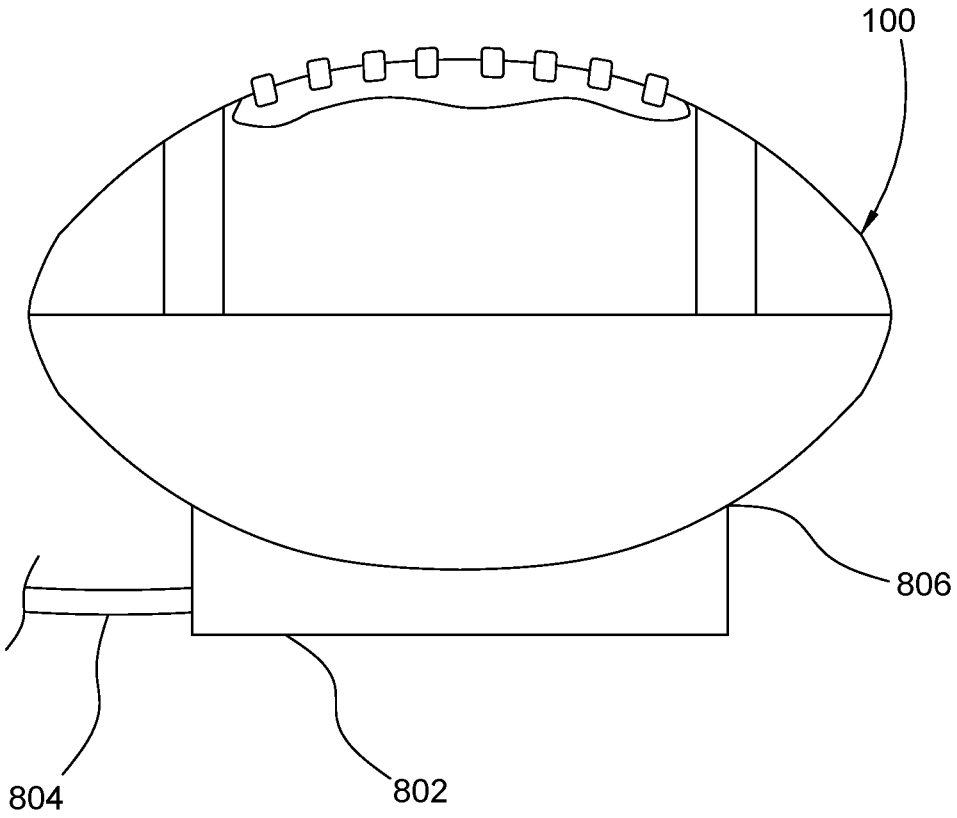
FIG. 8A is a side view of a wireless charger for use with a football device having a wireless sensor module, in accordance with some embodiments.
Figure 8B:
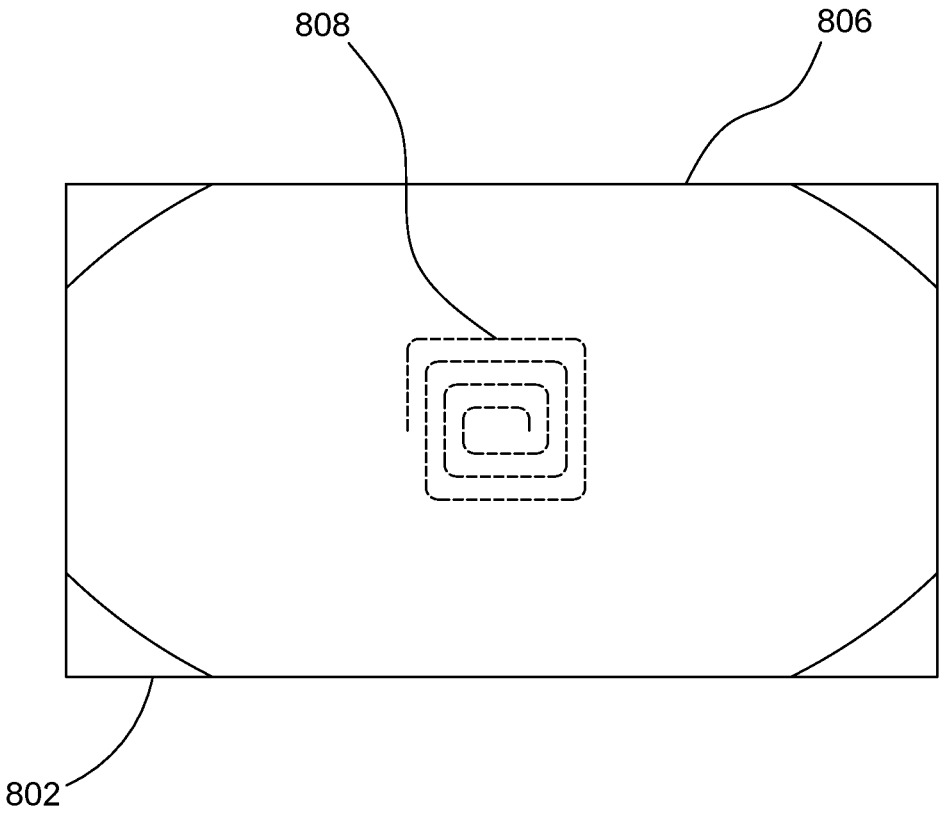
FIG. 8B is a top plan view of a wireless charger for use with a football device having a wireless sensor module, in accordance with some embodiments.

FIG. 8A is a side view of the football device 100, in accordance with some embodiments. The battery of the sensor unit is being charged by a wireless charger 802 that provides a cradle form for receiving and holding the football device 100. The charger 802 includes an inductive transmit coil to electromagnetically transmit energy via a wireless power signal to a pickup coil in the football device 100 that is connected to the sensor unit. The charger 802 can have a cable 804 for connecting to an electric power source. A top 806 of the charger 802 is shaped to conform to the exterior contour of the football device, and to hold it in position to keep it from rolling away. FIG. 8B shows an overhead view of the charger 802, without the football device 100 present. The top 806 is made of an electrically insulative material, and an inductive transmission coil 808 is disposed inside the charger at the top 806. When the football device 100 is placed in the charger 802, it is oriented to maximize the coupling of the transmission coil 808 and the pickup coil in the football device 100. During operation the charger 802 can periodically transmit a pulse in an attempt to detect a coupling with the pickup coil. Once a coupling is detected, the charger will activate the transmission coil with a continuous AC power signal until a loss of coupling is detected, or the sensor unit in the football device communicates back through the coupling that its battery is fully charged.

Figure 9A:
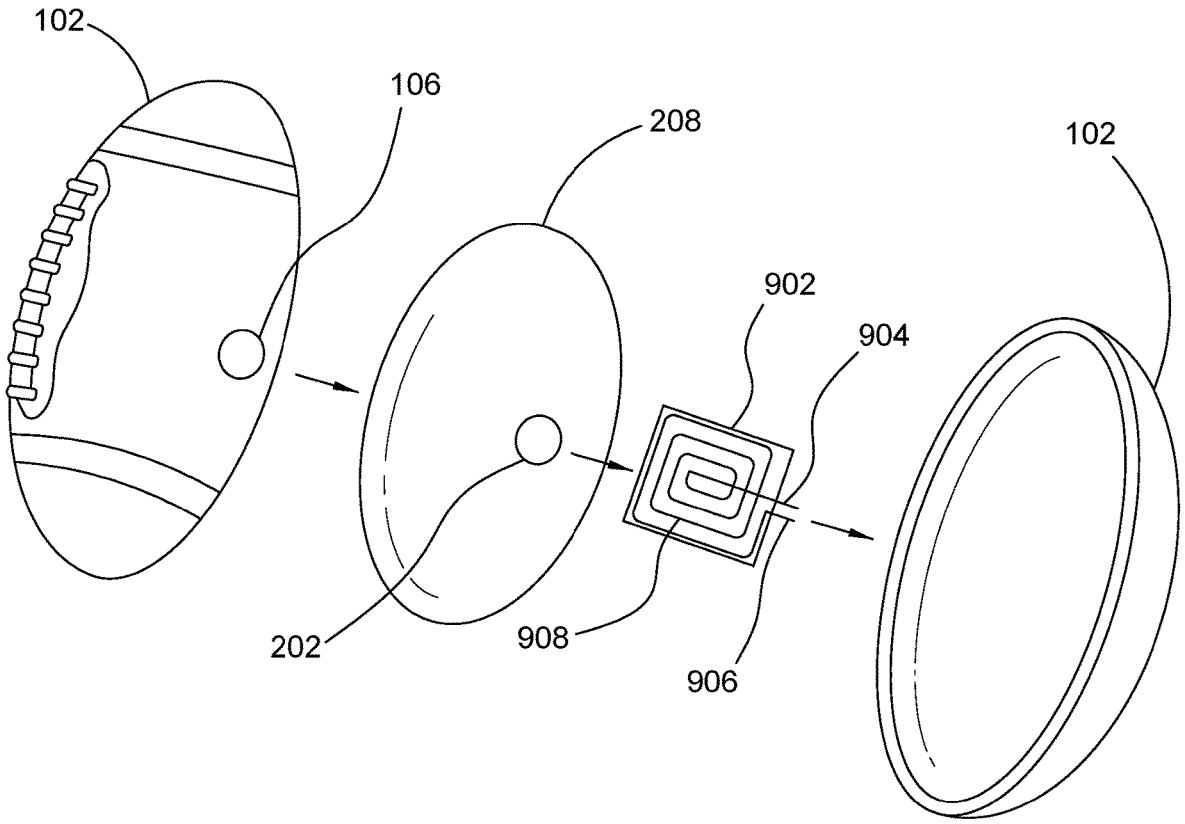
FIG. 9A is an exploded view of a football device having a sensor unit and a pickup coil for wirelessly recharging a battery of the sensor unit, in accordance with some embodiments.
Figure 9B:
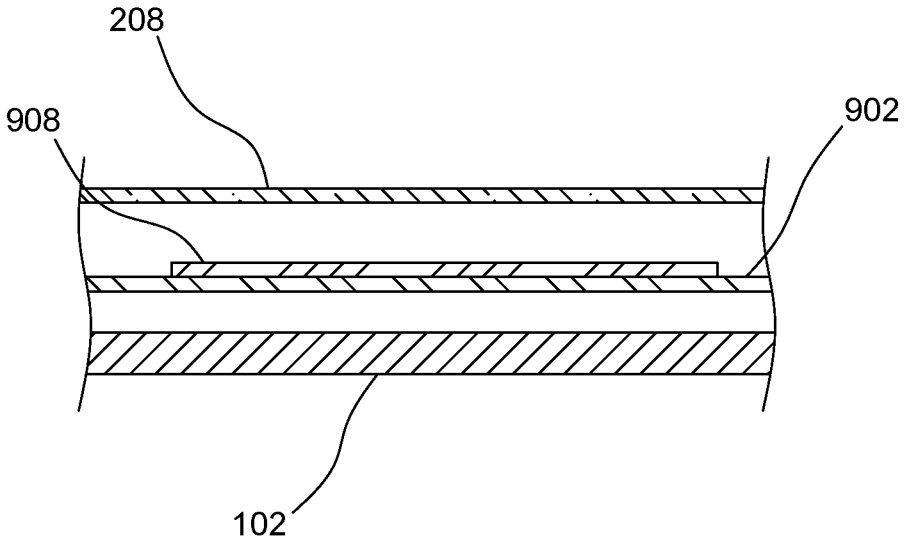
FIG. 9B is a side view of a wall of a football device showing a pickup coil located between the outer skin and bladder of the football device, in accordance with some embodiments.

FIG. 9A shows an exploded view of a football device such as football device 100 of FIG. 1, and having an inductive pickup coil, in accordance with some embodiments. In this view the football body 102 is shown in two halves for clarity of illustrating the construction, not to imply that the body 102 is actually formed in two halves. The bladder 208 is contained within the football body 102, and an inductive pickup coil 902 can be placed between the bladder 208 and the outer skin or wall of the football body 102. The inductive pickup coil 902 can be formed with a metal trace 908 on a flexible carrier such as, for example, polyamide. The coil 902 includes two terminals 904, 906 which can be connected to a power conditioning and rectifier circuit in the sensor unit for providing a DC (direct current) to the battery, thereby charging the battery of the sensor unit. In FIG. 9B there is shown a side cross sectional view of a portion of the football device. The football body 102 is outermost and at the bottom. The inductive pickup coil 902 with its trace 908 is captured between the football body 102 and the wall of the bladder 208. In the particular view of FIG. 9B there is separation shown between the layers (102, 902, 208) but in actuality the bladder 208 will be pressing against the pickup coil 902, in turn pressing the pickup coil 902 against the inner side of the football body 102.

Figure 10:
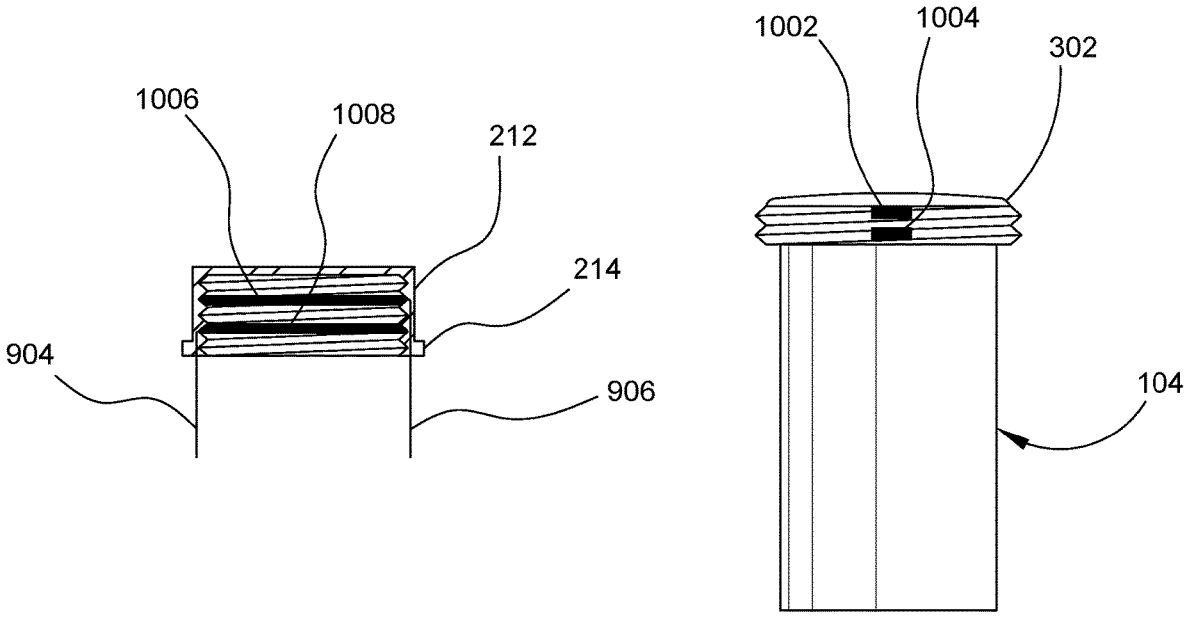
FIG. 10 shows side views of a receiving collar and sensor unit that is removably retained by the receiving collar, each having conductive electrodes to conduct electric power from a pickup coil in the football device to the sensor device, in accordance with some embodiments.

FIG. 10 shows a receiving member 212 and sensor unit 104 configured to facilitate inductive charging of the battery in the sensor unit 104, in accordance with some embodiments. The terminals 904, 906 of the pickup coil 902 are connected to electrode 1006, 1008 in the receiving member 212. When the sensor unit 104 is placed into the receiving member 212, mating electrodes 1002, 1004 on the side of the top 302 of the sensor unit 104, exposed among the threads. When the top is screwed into the receiving member 212 fully, then electrode 1002 will mate with electrode 1006, and 1004 with 1008 to allow a circuit connection with the pickup coil 902. Those skilled in the art will recognize that there are numerous similar and equivalent electrical contact connections that can be used to connect the pickup coil to the sensor unit.

Figure 11:
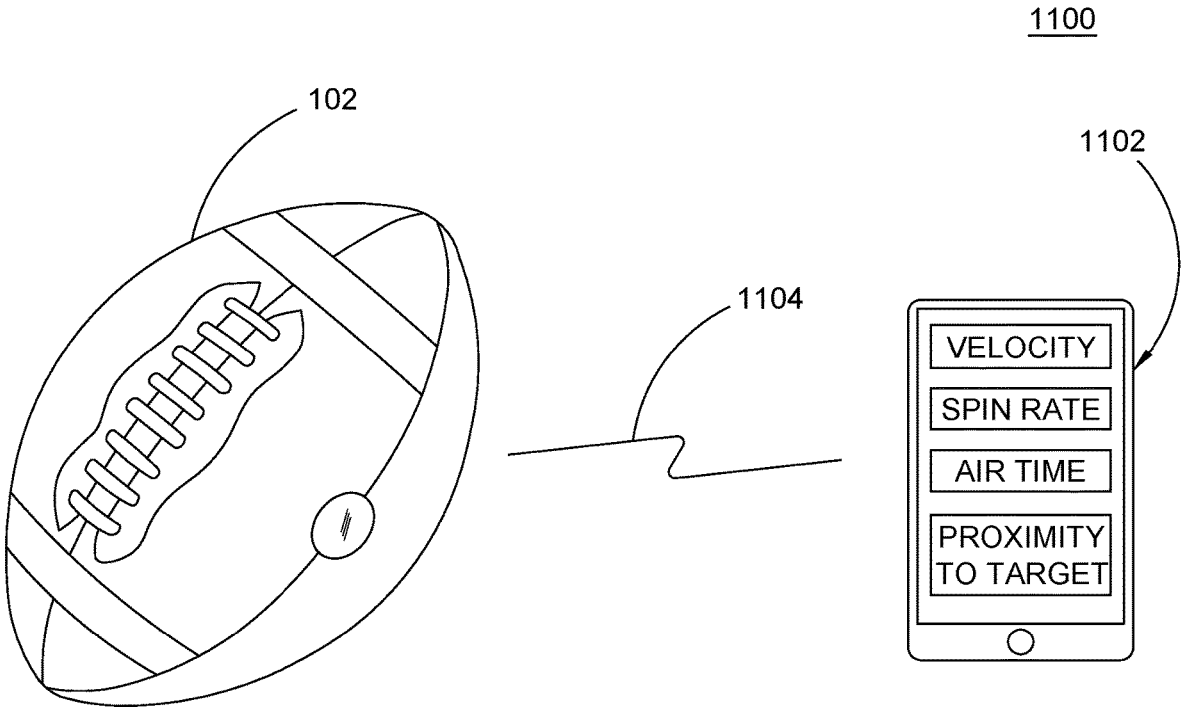
FIG. 11 shows a football device having a wireless sensor unit that is wirelessly connected to a remote device to allow viewing and analysis of data produced by the sensor unit, in accordance with some embodiments.

FIG. 11 shows a system diagram 1100 of a football device paired with a mobile device, in accordance with some embodiments. The football body 102 includes a sensor unit 104 that can wirelessly communicate with a mobile device 1102 over a wireless link 1104. The wireless link 1104 can be a link established in accordance with a wireless networking protocol, such as WiFi or BlueTooth, for example. Once the football device has been used, the sensor unit can transmit various data to the mobile device 1102 for display to a user. The mobile device 1102 can have an application program instantiated and executed therein that organizes and displays data in various user interfaces. Further, the application program and be used to control the sensor unit and communicate to the sensor unit. For example, the mobile device can provide location coordinates of a target (e.g. goal post) to the sensor unit, which can be used by the sensor unit to determine accuracy when the football device is thrown or kicked. The mobile device can be used to adjust settings, such as, for example, the magnitude of acceleration events that trigger that will be used by the sensor unit to detect being kicked, thrown, caught, impacting a surface, and so on. The settings can be adjusted based on the people using the football device. For example, lower settings can be used for young players, while higher settings can be used for older (e.g. college, professional) players to avoid false detections. Further, the number of acceleration events can be set. For example, when a person hikes the ball, that is one acceleration event. When the quarterback or other person catches the hiked ball, that is a second acceleration event. Thereafter, the ball may be thrown, kicked, handed off to another person, and so on. Settings to detect all of these events can be adjusted, and the metrics between each one of them can be captured and transmitted to the mobile device for analysis, and provide feedback to the athletes for training purposes.

Figure 12:
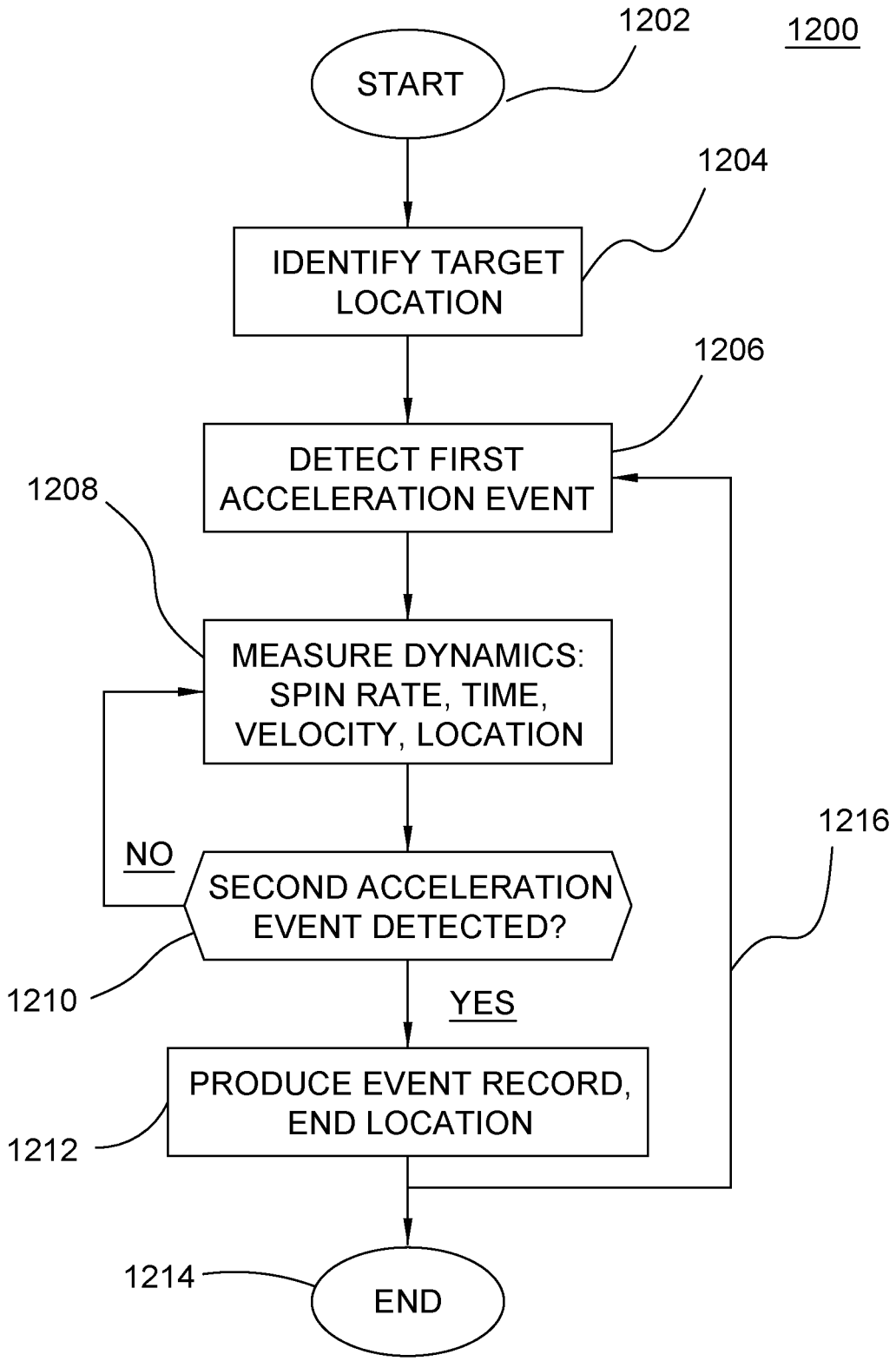
FIG. 12 is a flowchart diagram of a method of operating a football device having a sensor unit, in accordance with some embodiments.

FIG. 12 shows a flow chart diagram of a method 1200 for operating a motion sensing football device, in accordance with some embodiments. At the start, the football device is provided with a sensor unit such as sensor unit 104 having circuitry as in FIG. 4. At the start 1202, the sensor unit is turned on and activated, and wirelessly linked with a mobile device. At step 1204 the mobile device can communicate a target location, if a target location is necessary for a given training regimen being performed. The target location can be acquired by the mobile device, or already known, and can represent, for example, a goal post location (real or virtual), or any other location used as a target for a training exercise. Once the sensor device has been provisioned and its settings adjusted for the particular training exercise, then in step 1206 the sensor unit begins monitoring the output of the accelerometer in order to detect the occurrence of a suitably large acceleration event exceeding a given setting threshold. Then, in step 1208, the sensor unit continues to record data output by the various senor circuits (acceleration, spin, velocity, altitude, time, etc.) until, in step 1210, a second acceleration event is detected indicating the end of the training exercise, or one segment of the training exercise (if there are multiple segments). In step 1212 the logged data has been recorded, and can be transmitted to the mobile device for viewing and analysis. The method can end in step 1214 if the training exercise is complete, or alternatively, the method can return to step 1206 for another iteration of the training exercise.

In addition to a football device as exemplified in the drawings, it is contemplated that the inventive sensor unit and recharging arrangement in an athletic ball can incorporated into other ball configurations. This can include both inflatable, and non-inflatable/rigid ball configurations. For example, it is contemplated that the use of a sensor unit, counterweight, and pickup coil for recharging can be included in a configurations for a basketball, soccer ball, volley ball, baseball, bowling ball, tennis ball, and other similar configurations. In each ball configuration, the sensor unit is configured to detect acceleration events, and measure various parameters between these events which can include velocity, spin rate, time, altitude, location, and other dynamic aspects. The sensor device can be programmed for a particular training exercise by the number of acceleration events, the settings for the acceleration events, and what to record in between and during the various acceleration events, and even after the last acceleration event (e.g. proximity). This data can then be transmitted to a remote device for viewing and analysis.

An athletic ball device has been disclosed that includes a wireless sensor device for sensing various performance metrics when the ball device is used in a training exercise. The ball device incudes a wireless charging interface that allows a battery in the sensor unit to be charged without having to remove the sensor unit. This allows the ball device to be constructed in a way that is very similar to an actual football as used in games, which do not have any sensors. Specifically, the inventive ball device can include a skin and bladder that are substantially identical to an ordinary football, providing a very similar feel to an actual football when training with the ball device. The sensor unit is mounted securely in the football device in a way that withstands the impact of the ball device being thrown, kicked, dropped, etc. By being wirelessly rechargeable, the sensor unit can be secured in the ball device to withstand these training events.

What is claimed is:

1. A ball device, comprising:

a body having an outer skin surrounding a bladder;

an inflation valve passing through the outer skin and the bladder to allow inflation of the bladder a first opening in the outer skin and a second opening in the outer skin at opposing sides of the body;

a first sleeve extending into the body and the bladder at the first opening and having a first sleeve opening at the first opening in the outer skin, a second sleeve extending into the body and the bladder at the second opening and having a second sleeve opening at the second opening in the outer skin;

wherein the first and second sleeves are rigid;

a first sensor unit configured to be housed and retained in the body in the first sleeve;

a pickup coil disposed inside the body, wherein the pickup coil has two terminals which are each coupled to a respective one of a pair of electrodes in a threaded portion of the first sleeve that mate with corresponding ones of a pair of electrodes on the first sensor unit, wherein the electrodes on the first sensor unit are disposed in threads on the first sensor unit that engage the threaded portion of the first sleeve;

a counterweight or second sensor unit configured to be housed and retained in the body in the second sleeve; and wherein the first sensor unit includes circuitry for measuring acceleration, altitude, and proximity to a proximity beacon.

2. The ball device of claim 1, wherein the body is configured in an American football configuration.

3. The ball device of claim 1, wherein the pickup coil is disposed between the outer skin and the bladder.

4. The ball device of claim 1, wherein the first sensor unit comprises threads that mate with corresponding threads in a collar in the first opening.

5. The ball device of claim 1, wherein the first sensor unit comprises:

a processor;

an accelerometer operably coupled to the processor;

a satellite location receiver that is operably coupled to the processor;

a wireless networking transceiver operably coupled to the processor; and wherein the processor is configured to detect acceleration events as indicated by an output of the accelerometer.

6. A ball device, comprising:

a body having a size, shape, and weight that are substantially similar to an athletic ball;

the body includes an outer skin and a bladder housed inside the outer skin that is configured to be inflated, the outer skin further including an opening, the bladder having a pocket that is aligned with the opening in the outer skin;

a sleeve disposed in the body and having a sleeve opening, the sleeve being rigid, the sleeve disposed in the pocket of the bladder such that the sleeve opening is aligned with the opening in the outer skin, the sleeve having a flange proximate to the sleeve opening that extends outward and around the sleeve, wherein the flange is disposed between the outer skin and the bladder;

at least one sensor unit disposed in the sleeve and removably retained in the sleeve, the sensor unit including a rechargeable battery, an accelerometer, a processor operably coupled to the accelerometer, at least one of a proximity sensor or a satellite location receiver, and a wireless networking transceiver, wherein an outer surface of the at least one sensor unit is flush with an outer surface of the outer skin;

wherein the at least one sensor includes the proximity sensor, and wherein the proximity sensor is configured to determine a proximity of the ball device to a proximity beacon by measuring a signal strength of a signal transmitted by the proximity beacon; and a pickup coil operably coupled to the sensor unit.

7. The ball device of claim 6, wherein the opening in the outer skin is a first opening, the sleeve is a first sleeve, the outer skin includes a second opening opposite the first opening, and the bladder includes a second sleeve opposite the first sleeve, the ball device further includes a counterweight removably retained in the second sleeve, wherein the counterweight has a weight that is equal to a weight of the at least one sensor unit removably retained in the first sleeve.

* * * * *